US011145945B2

(12) United States Patent
Su et al.

(10) Patent No.: US 11,145,945 B2
(45) Date of Patent: Oct. 12, 2021

(54) DIELECTRIC FILTER

(71) Applicant: Samsung Electronics Co., Ltd., Gyeonggi-do (KR)

(72) Inventors: Rongbiao Su, Guangdong (CN); Zhou Chen, Guangdong (CN); Ruoming Wang, Guangdong (CN)

(73) Assignee: Samsung Electronics Co., Ltd

( * ) Notice: Subject to any disclaimer, the term of this patent is extended or adjusted under 35 U.S.C. 154(b) by 0 days.

(21) Appl. No.: 16/800,707

(22) Filed: Feb. 25, 2020

(65) Prior Publication Data

US 2021/0091440 A1 Mar. 25, 2021

(30) Foreign Application Priority Data

Sep. 25, 2019 (CN) ..... 201910909948.1

(51) Int. Cl.
*H01P 1/20* (2006.01)
*H01P 7/10* (2006.01)
*H01P 1/205* (2006.01)

(52) U.S. Cl.
CPC ..... *H01P 1/2002* (2013.01); *H01P 1/2056* (2013.01); *H01P 7/10* (2013.01)

(58) Field of Classification Search
CPC ..... H01P 1/20; H01P 1/2002; H01P 1/201; H01P 1/207; H01P 1/208; H01P 1/2082; H01P 1/2084; H01P 1/2086; H01P 1/2088; H01P 1/211; H01P 1/2056; H01P 1/205; H01P 7/10; H01P 7/105
USPC ..... 333/202, 208, 209, 212, 219.1
See application file for complete search history.

(56) References Cited

U.S. PATENT DOCUMENTS 4,431,977 A * 2/1984 Sokola ..... H01P 7/04 333/202
2002/0003456 A1* 1/2002 Tada ..... H01P 1/2136 333/134
2002/0030558 A1 3/2002 Tsukamoto et al.
2003/0184416 A1 10/2003 Ono et al.
(Continued)

FOREIGN PATENT DOCUMENTS

CN 108598635 9/2018
JP 05-022002 1/1993
(Continued)

OTHER PUBLICATIONS

International Search Report dated Jun. 23, 2020 issued in counterpart application No. PCT/KR2020/002741, 8 pages.

*Primary Examiner* — Stephen E. Jones
(74) *Attorney, Agent, or Firm* — The Farrell Law Firm, P.C.

(57) ABSTRACT

A dielectric filter includes a plurality of resonators, wherein each resonator included in the plurality of resonators includes a tuning hole; and at least one stepped hole for adjusting capacitive coupling, wherein the at least one stepped hole is disposed between two adjacent resonators included in the plurality of the resonators, wherein the stepped hole comprises a large hole and a small through hole at a bottom center of the large hole, wherein a first sidewall and a first annular bottom of the large hole are configured with a metal conductive layer, and wherein at least one of a second sidewall of the small through hole and a second annular portion outside a bottom of the small through hole is not covered with the conductive layer.

13 Claims, 5 Drawing Sheets

(56) References Cited

U.S. PATENT DOCUMENTS

| | | | | |
|---|---|---|---|---|
| 2004/0119564 | A1* | 6/2004 | Itoh | H01P 1/2088<br>333/208 |
| 2016/0094265 | A1 | 3/2016 | Yuan | |
| 2016/0099492 | A1* | 4/2016 | Yuan | H01P 1/2002<br>333/134 |

FOREIGN PATENT DOCUMENTS

| | | |
|---|---|---|
| JP | 10-224111 | 8/1998 |
| JP | 2003-298313 | 10/2003 |
| KR | 1019990074882 | 10/1999 |
| WO | WO 2019-104901 | 6/2019 |

* cited by examiner

DIELECTRIC FILTER

CROSS-REFERENCE TO RELATED APPLICATION(S)

This application is based on and claims priority under 35 U.S.C. § 119 to Chinese Patent Application No. 201910909948.1, filed on Sep. 25, 2019, in the Chinese Intellectual Property Office, the disclosure of which is incorporated by reference herein in its entirety.

BACKGROUND

1. Field

The disclosure relates generally to dielectric filters.

2. Description of Related Art

Dielectric filters are widely used in signal filtering scenarios, such as in base stations. With the advancement of radio communication technologies, performance requirements on dielectric filters are becoming more demanding in various application scenarios. Dielectric filters may include multiple resonators coupled to form the filter. It is difficult to make adjustments to the coupling of the resonators after matching of the current dielectric filter is completed.

SUMMARY

The present disclosure has been made to address the above-mentioned problems and disadvantages, and to provide at least the advantages described below. In accordance with an embodiment, a dielectric filter includes a plurality of resonators, wherein each resonator included in the plurality of resonators includes a tuning hole; and at least one stepped hole for adjusting capacitive coupling, wherein the at least one stepped hole is disposed between two adjacent resonators included in the plurality of the resonators, wherein the stepped hole comprises a large hole and a small through hole at a bottom center of the large hole, wherein a first sidewall and a first annular bottom of the large hole are configured with a metal conductive layer, and wherein at least one of a second sidewall of the small through hole and a second annular portion outside a bottom of the small through hole is not covered with the conductive layer.

In accordance with another embodiment, a dielectric filter comprises a plurality of resonators including a first resonator, a tail resonator, a second resonator connected in series between the first resonator and the tail resonator, and a third resonator connected in series between the first resonator and the tail resonator; a first stepped hole provided between the first resonator and the second resonator; and a second stepped hole provided between the tail resonator and the second resonator.

BRIEF DESCRIPTION OF THE DRAWINGS

The above and other aspects, features, and advantages of certain embodiments of the disclosure will be more apparent from the following detailed description taken in conjunction with the accompanying drawings, in which.

DETAILED DESCRIPTION

Figure 1:
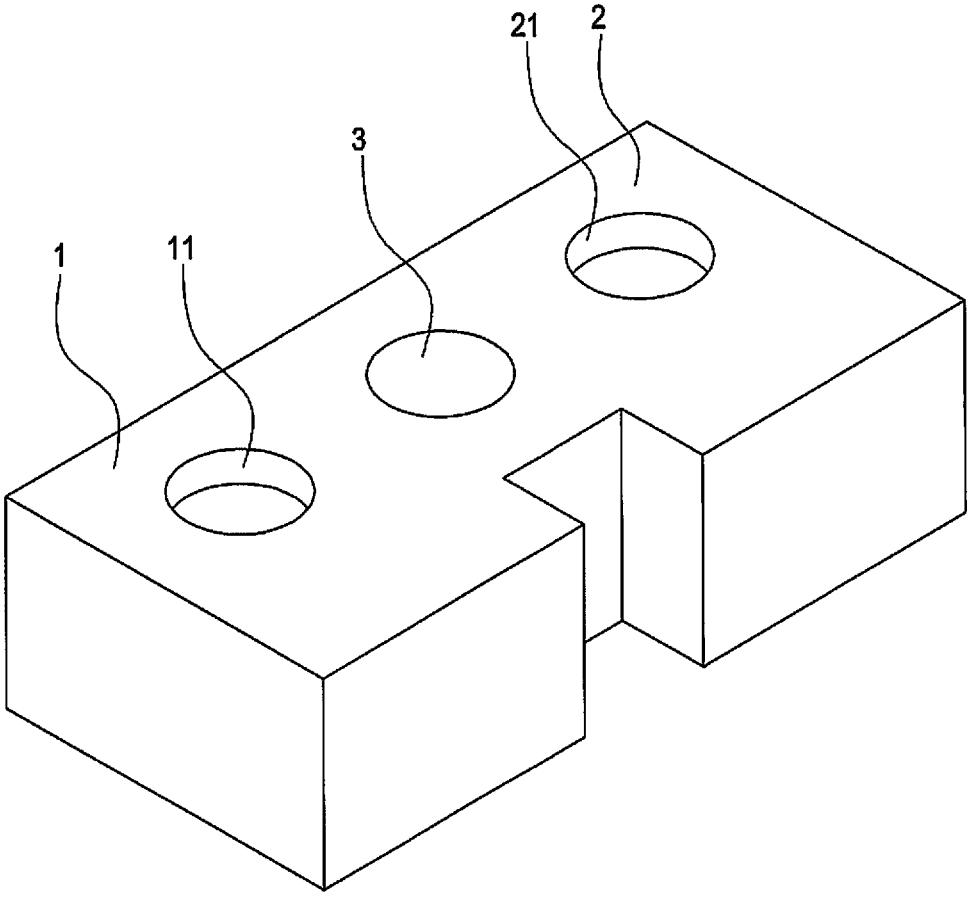
FIG. 1 is a schematic diagram illustrating a partial structure of a dielectric filter, according to an embodiment.

Various embodiments of the present disclosure are described with reference to the accompanying drawings. However, various embodiments of the present disclosure are not limited to particular embodiments, and it should be understood that modifications, equivalents, and/or alternatives of the embodiments described herein can be variously made. With regard to description of drawings, similar components may be marked by similar reference numerals.

FIG. 1 is a schematic diagram illustrating a partial structure of a dielectric filter, according to an embodiment.

Referring to FIG. 1, the dielectric filter includes resonators 1 and 2. Each resonator may include a tuning hole. Resonator 1 has tuning hole 11, and resonator 2 has tuning hole 21. The tuning holes 11 and 21 are blind (i.e., recessed) holes provided on the resonators 1 and 2. A tuning hole and a dielectric in the resonator may form a resonant cavity. A solid part of each resonator may be a dielectric, such as ceramic, glass, or an insulating high molecular polymer.

Additionally, the dielectric filter may include at least one stepped hole. The stepped hole may adjust capacitive coupling. Each stepped hole may be located between two adjacent resonators in the dielectric filter.

Referring again to FIG. 1, a stepped hole 3 is located between the resonator 1 and the resonator 2.

Figure 2:
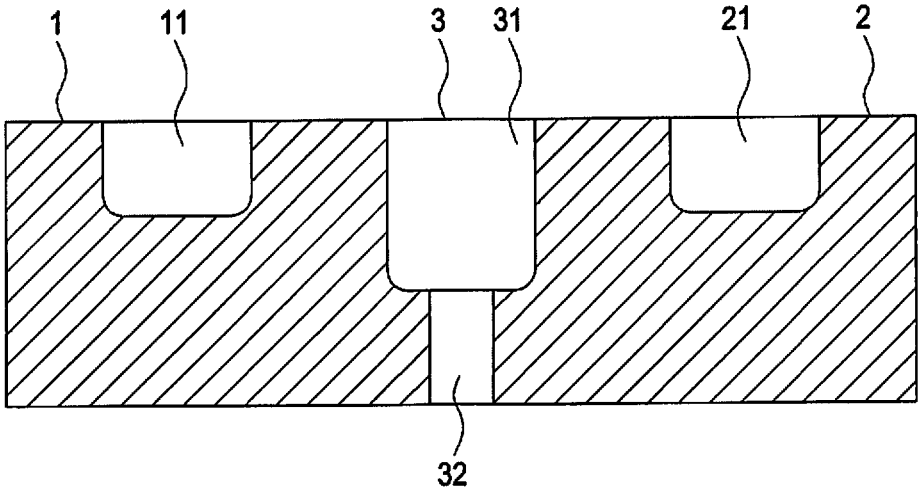
FIG. 2 is a cross-sectional view of the dielectric filter of FIG. 1, according to an embodiment.

FIG. 2 is a cross-sectional view of the dielectric filter of FIG. 1, according to an embodiment.

Referring to FIG. 2, the stepped hole 3 includes a large hole 31 and a small through hole 32 at a center of a bottom of the large hole 31. Both a sidewall and an annular bottom of the large hole 31 are configured with a metal conductive layer. Here, the metal conductive layer is, for example, a silver material, but is not limited thereto.

Figure 3:
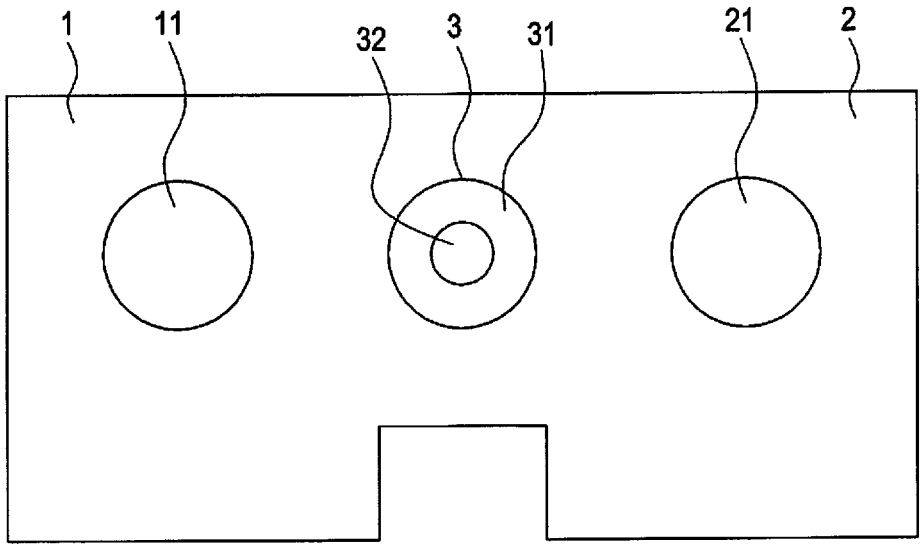
FIG. 3 is a top view of the dielectric filter of FIG. 1, according to an embodiment.

FIG. 3 is a top view of the dielectric filter of FIG. 1, according to an embodiment.

Referring to FIG. 3, at least one of a sidewall of the small through hole 32 and an annular portion 33 outside the bottom of the small through hole 32 is not covered with the conductive layer. The depth of the large hole 31 may be greater than the depth of the tuning hole.

Figure 4A:
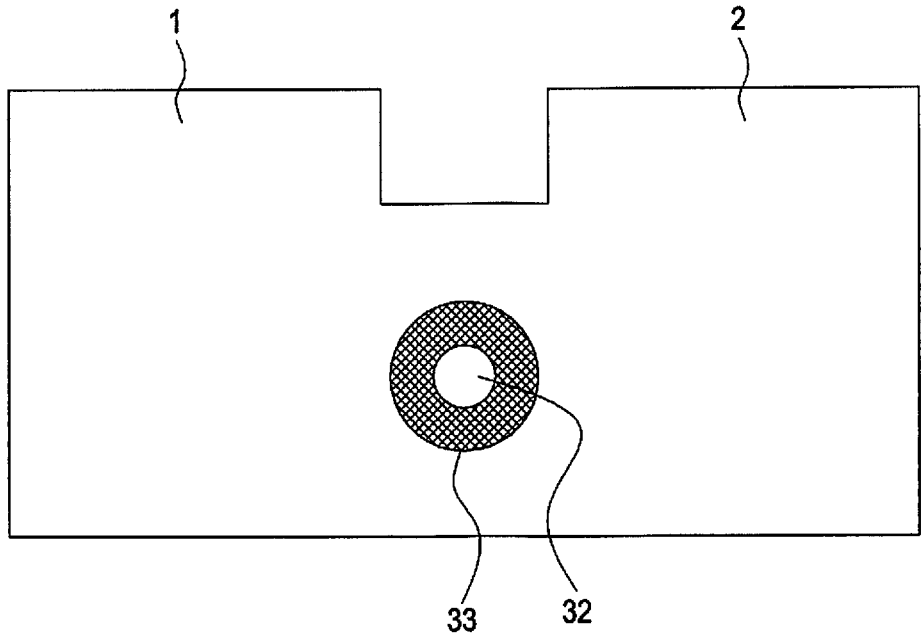
FIG. 4A is a bottom view of a dielectric filter, according to an embodiment.
Figure 4B:
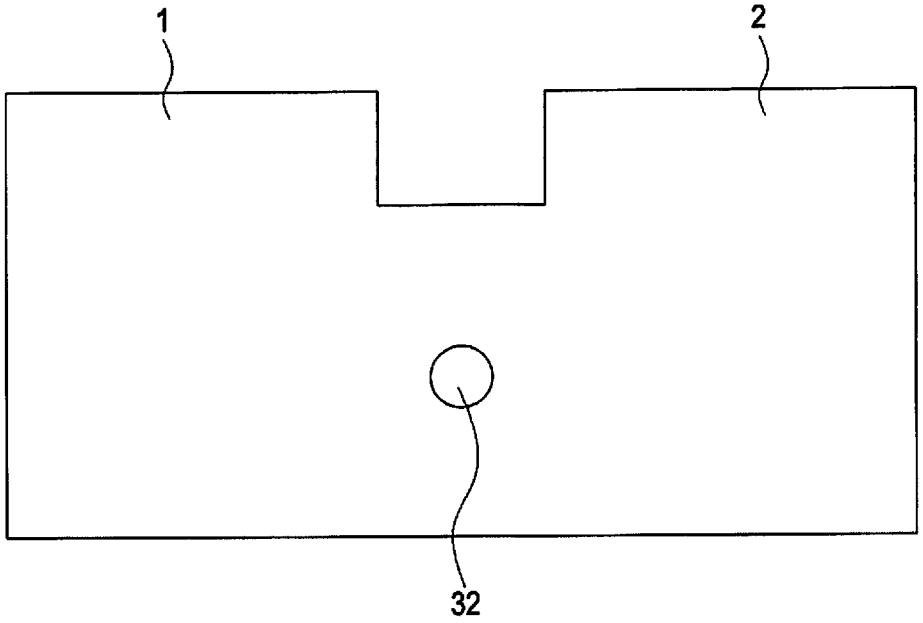
FIG. 4B is a bottom view of a dielectric filter, according to an embodiment.

FIGS. 4A and 4B are bottom views of a dielectric filter, according to various embodiments. The dielectric filters illustrated in FIGS. 4A and 4B may or may not correspond to the dielectric filter illustrated in FIGS. 1-3.

Referring to FIG. 4A, the annular portion 33 outside the bottom of the small through hole 32 is not covered with the conductive layer, while the sidewall of the small through hole 32 is covered with the conductive layer.

Referring to FIG. 4B, the conductive layer is provided outside the bottom of the small through hole 32. In addition, the sidewall of the small through hole 32 is not covered with the conductive layer.

The metal conductive layer is provided on the sidewall and the bottom of the large hole 31, at least one of the sidewall of the small through hole 32 at the bottom of the large hole 31 and the annular portion 33 outside the bottom of the small through hole 31 is not covered with the conductive layer, and the depth of the large hole 31 may be greater than the depth of the tuning hole, thereby causing the stepped hole 3 to implement capacitive coupling.

The stepped hole 3 may generate a resonant frequency lower than a working pass band. Adjacent cavities may be coupled to each other through the stepped hole 3 to generate capacitive coupling, which may be tunable. The stepped hole 3 may be located between two adjacent resonators 1 and 2 to form a resonant cavity. In other words, the stepped hole 3 and the dielectric near the stepped hole 3 may form the resonant cavity.

The dielectric filter may flexibly adjust a capacitive coupling amount (i.e., adjust a value) between adjacent resonators 1 and 2 by configuring the metal conductive layer to be on (i.e., to cover) the sidewall and the bottom of the large hole 31 in the stepped hole 3, and not to be on (i.e., not to cover) at least one of the sidewall of the small through hole 32 at the bottom of the large hole 31 and the annular portion 33 outside the bottom of the small through hole 32.

For example, the capacitive coupling amount between resonators 1 and 2 may be adjusted by sanding the sidewall and the annular bottom of the large hole 31. When the area of the metal conductive layer on the sidewall of the large hole 31 is reduced, the capacitive coupling amount between the resonators 1 and 2 on both sides of the stepped hole 3 may be reduced. When the area of the metal conductive layer on the bottom of the large hole 31 of the stepped hole 3 is reduced, the capacitive coupling amount between the resonators 1 and 2 on both sides of the stepped hole 3 may be increased.

Additionally, when the annular portion 33 outside the bottom of the small through hole 32 is not covered with the conductive layer and the sidewall of the small through hole 32 is covered with the conductive layer, increasing a diameter of the annular portion (i.e., a diameter of an outer circumference of the annular portion) may increase the amount of (i.e., a value of) capacitive coupling between the resonators 1 and 2 on both sides of the stepped hole.

In addition, due to the structure of the stepped hole 3, the dielectric filter may reduce a return loss and increase an adjustment range of an amount of coupling between the resonators 1 and 2. In addition, the dielectric filter may implement broadband coupling between the resonators 1 and 2 by not covering the conductive layer on the annular portion outside the bottom of the small through hole 32.

A tuning hole 11 of each resonator 1 or 2 may be a blind (i.e., hidden) hole in the vertical direction and may have an opening on an upper surface of each resonator 1 or 2. Each stepped hole 3 may be located between two adjacent tuning holes 11 and 21 of the plurality of resonators 1 and 2. The stepped hole 3 may be a through hole in the vertical direction. The large hole 31 of the stepped hole 3 may have openings on upper surfaces of the plurality of resonators 1 and 2.

After the dielectric filter is soldered into a circuit board, an upper surface of the dielectric filter may be covered with a shielding layer. The shielding layer may cover the openings of the large hole 31 at the upper surfaces of the plurality of resonators 1 and 2, and cover the opening of each tuning hole 11 and 21 at the upper surface of each resonator. In this way, the shielding layer may avoid signal leakage at the stepped hole 3 and the tuning holes 11 and 21 of the dielectric filter.

The depth of the large hole 31 may be greater than the depth of a tuning hole 11 and 21. For example, the depth of the large hole 31 may be twice of that of the tuning hole 11. The depth of the small through hole 32 may be less than the depth of the large hole 31. The diameter of the large hole 31 may be identical to the diameter of the tuning hole 11, and the diameter of the small through hole 32 may be less than one-half of the diameter of the large hole 31. For example, the diameter of the small through hole 32 may be one third of the diameter of the large hole 31.

The dielectric filter may resonators in addition to resonators 1 and 2. That is, the dielectric filter may include a first resonator, a tail resonator, and at least one resonator connected in series between the first resonator and the tail resonator. A stepped hole may be disposed between the first resonator and an adjacent resonator (i.e., either the tail resonator or the at least one resonator connected in series). A stepped hole may be disposed between the tail resonator and an adjacent resonator (i.e., either the first resonator or the at least one resonator connected in series).

Figure 5:
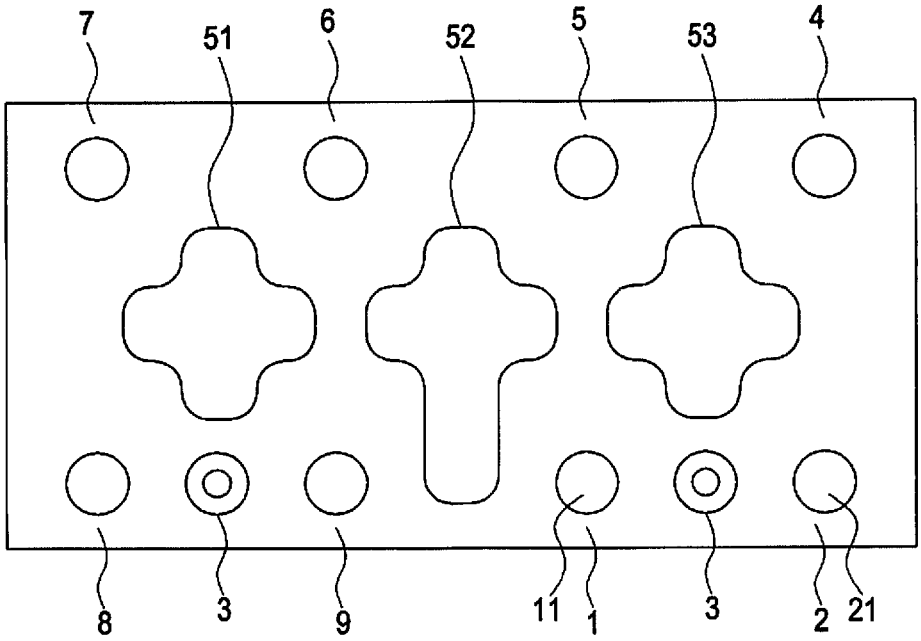
FIG. 5 is a schematic diagram illustrating a dielectric filter, according to an embodiment.

FIG. 5 is a schematic diagram illustrating a dielectric filter, according to an embodiment.

Referring to FIG. 5, the dielectric filter includes a first resonator 1 and a tail resonator 9. There are six resonators connected in series between the first resonator 1 and the tail resonator 9, which are resonators 2, 4, 5, 6, 7, and 8, respectively. A stepped hole 3 is provided between the first resonator 1 and the resonator 2, which is adjacent to the first resonator 1. A stepped hole 3 is provided between the tail resonator 9 and the resonator 8, which is adjacent to the tail resonator 9.

In this case, the first resonator 1 and the resonator 2 are negatively coupled (i.e., capacitive coupling), and any two adjacent resonators of the resonators 2, 4, 5, 6, 7, and 8 are positively coupled (i.e., inductive coupling). The resonator 8 and the tail resonator 9 are negatively coupled.

The dielectric filter of FIG. 5 may be manufactured from a piece of dielectric material. The dielectric material may be divided into eight resonators corresponding to three "+" shaped through slots 51, 52, and 53.

Figure 6:
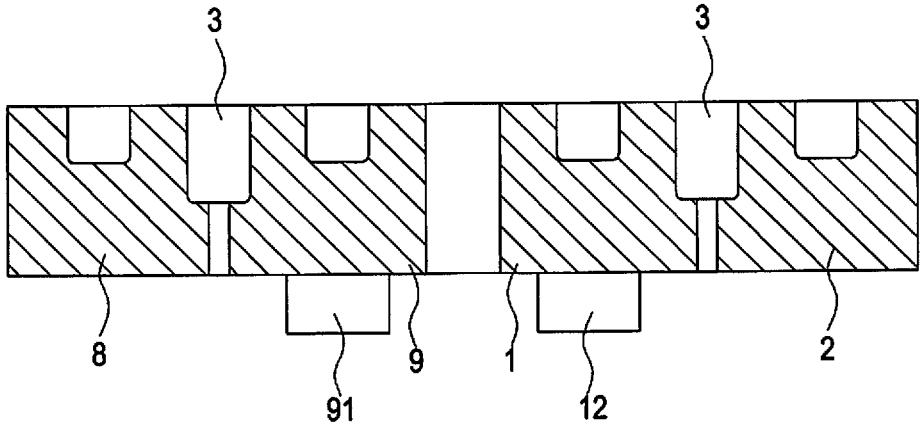
FIG. 6 is a cross-sectional view of the dielectric filter of FIG. 5, according to an embodiment.

FIG. 6 is a cross-sectional view of the dielectric filter of FIG. 5, according to an embodiment.

Referring to FIG. 6, the first resonator 1 is provided with a signal input end 12. The tail resonator 9 is provided with a signal output end 91. A signal in the signal input end passes through the first resonator 1, the resonators 2, 4, 5, 6, 7, and 8, and the tail resonator 9.

The signal input end 12 may be disposed at the bottom center of the first resonator 1. The signal output end 91 may be disposed at the bottom center of the tail resonator 9.

Figure 7:
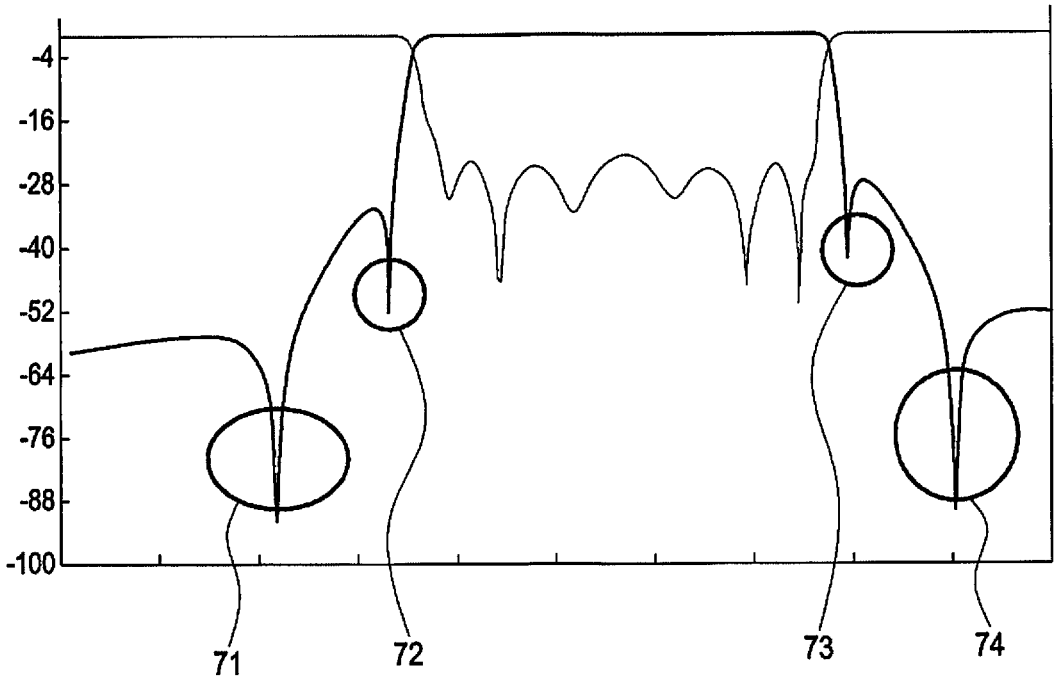
FIG. 7 is a schematic diagram illustrating frequency attenuation of the dielectric filter of FIG. 5, according to an embodiment.

FIG. 7 is a schematic diagram illustrating frequency attenuation of the dielectric filter of FIG. 5, according to an embodiment.

Referring to FIG. 7, positions 71, 72, 73 and 74 respectively show a zero transmission point of the dielectric filter. The zero transmission point refers to a frequency point other than the pass band (i.e., stop band) of the dielectric filter.

Accordingly, a capacitive coupling amount between the resonators 1 and 2 on both sides of the stepped hole 3 may be reduced by reducing an area of the metal conductive layer on the sidewall of any one of the large holes of the stepped holes.

The capacitive coupling amount between the resonators 1 and 2 on both sides of the stepped hole 3 may be increased by reducing an area of the metal conductive layer at the bottom of any one of the large holes of the stepped holes.

When the annular portion 33 outside the bottom of the small through hole 32 of any one of the stepped holes is not covered with the conductive layer, the capacitive coupling amount between the resonators 1 and 2 on both sides of the stepped hole 3 may be increased by increasing a diameter of the annular portion 33.

The tuning hole of each resonator may be a blind hole in a vertical direction with an opening on an upper surface of each resonator, each stepped hole 33 may be located between two adjacent tuning holes included in the plurality of resonators, the stepped hole 33 may be a through hole in the vertical direction, and the large hole 31 of the stepped hole 33 may have openings on upper surfaces of the plurality of the resonators.

A shielding layer may be configured on the upper surfaces of the plurality of the resonators, the shielding layer may cover the openings of the large hole 31 at the upper surfaces of the plurality of the resonators, and cover the opening of each tuning hole at the upper surface of each resonator.

A depth of the large hole may be greater than a depth of the tuning hole, and/or a depth of the small through hole may be less than the depth of the large hole.

A diameter of the large hole may be identical to (i.e., within a predetermined margin of similarity, such as within 1% or less of a value) a diameter of the tuning hole, and/or, a diameter of the small through hole may be less than one-half of the diameter of the large hole.

The plurality of the resonators may include a first resonator 1, a tail resonator 9, and at least one resonator connected in series between the first resonator 1 and the tail resonator 9, a stepped hole 33 may be provided between the first resonator 1 and an adjacent resonator; and a stepped hole may be provided between the tail resonator 9 and the adjacent resonator.

The first resonator 1 may be provided with a signal input end. The tail resonator 9 may be provided with a signal output end. A signal in the signal input end may pass through the first resonator 1, at least one series resonator, and the tail resonator 9.

The signal input end may be disposed at the bottom center of the first resonator 1, and the signal output end may be disposed at the bottom center of the tail resonator 9.

Six resonators may be connected in series between the first resonator 1 and the tail resonator 9.

The stepped hole may be located between two adjacent resonators to form a resonant cavity.

In summary, a dielectric filter may flexibly adjust a capacitive coupling amount between adjacent resonators by configuring a metal conductive layer on a sidewall and a bottom of a large hole in a stepped hole, and not cover at least one of a sidewall of a small through hole at the bottom of the large hole or the annular portion outside the bottom of the small through hole with a conductive layer.

For example, a capacitive coupling amount between resonators may be adjusted by sanding the sidewall and the annular bottom of the large hole. When the area of the metal conductive layer on the sidewall of the large hole is reduced, the capacitive coupling amount between the resonators on both sides of the stepped hole may be reduced. When the area of the metal conductive layer on the bottom of the large hole of the stepped hole is reduced, the capacitive coupling amount between the resonators on both sides of the stepped hole may be increased. When the annular portion outside the bottom of the small through hole is not covered with the conductive layer and the sidewall of the small through hole is covered with the conductive layer, decreasing a diameter of the annular portion may reduce the capacitive coupling amount between the resonators on both sides of the stepped hole.

In addition, due to the structure of the stepped hole, the dielectric filter may reduce a return loss and increase an adjustment range of a coupling amount between the resonators. In addition, the dielectric filter may implement broadband coupling between the resonators by not covering the conductive layer on the annular portion outside the bottom of the small through hole.

While the present disclosure has been particularly shown and described with reference to certain embodiments thereof, it will be understood by those of ordinary skill in the art that various changes in form and details may be made therein without departing from the spirit and scope of the disclosure as defined by the appended claims and their equivalents.

What is claimed is:

1. A dielectric filter, comprising:

a plurality of resonators, wherein each resonator included in the plurality of resonators comprises a tuning hole; and at least one stepped hole for adjusting capacitive coupling, wherein the at least one stepped hole is disposed between two adjacent resonators included in the plurality of the resonators, wherein the stepped hole comprises a large hole and a small through hole at a bottom center of the large hole, wherein a first sidewall and a first annular bottom of the large hole are configured with a metal conductive layer, and wherein at least one of a second sidewall of the small through hole and a second annular portion of the large hole beyond a perimeter of the small through hole is not covered with the conductive layer.

2. The dielectric filter of claim 1, wherein capacitive coupling between a first resonator on a first side of the stepped hole and a second resonator on a second side opposite to the first side of the stepped hole is adjusted by reducing an amount of capacitive coupling between the first resonator and the second resonator by reducing an area of the metal conductive layer on the first sidewall of the large hole of at least one stepped hole.

3. The dielectric filter of claim 1, wherein capacitive coupling between a first resonator on a first side of the stepped hole and a second resonator on a second side opposite to the first side of the stepped hole is adjusted by increasing an amount of capacitive coupling between the first resonator and the second resonator by reducing an area of the metal conductive layer at the bottom of the large hole of at least one stepped hole.

4. The dielectric filter of claim 1, wherein capacitive coupling between a first resonator on a first side of the stepped hole and a second resonator on a second side opposite to the first side of the stepped hole is adjusted by increasing an amount of capacitive coupling between the first resonator and the second resonator by increasing a diameter of the second annular portion, in a case when the second annular portion of the large hole beyond the perimeter of the small through hole of at least one stepped hole is not covered with the conductive layer.

5. The dielectric filter of claim 1, wherein a depth of the large hole is greater than a depth of the tuning hole included in each resonator, or a depth of the small through hole is less than the depth of the large hole.

6. The dielectric filter of claim 1, wherein a diameter of the large hole is approximately equal to a diameter of the tuning hole included in each resonator, or a diameter of the small through hole is less than one-half of the diameter of the large hole.

7. The dielectric filter of claim 1, wherein the stepped hole located between two adjacent resonators forms a resonant cavity.

8. The dielectric filter of claim 1, wherein each tuning hole comprised in each resonator is a blind hole in a vertical direction and has an opening on an upper surface of each resonator, and wherein the at least one stepped hole is located between two adjacent tuning holes included in the plurality of the resonators, the at least one stepped hole is a through hole in the vertical direction, and the large hole of the at least one stepped hole has at least one opening on at least one upper surface of at least one resonator included in the plurality of resonators.

9. The dielectric filter of claim 8, wherein a shielding layer is configured on the at least one upper surface of at least one resonator included in the plurality of resonators, and wherein the shielding layer covers the at least one opening of the large hole on the at least one upper surface of the at least one resonator included in the plurality of resonators, and covers each opening of each tuning hole on the upper surface of each resonator.

10. The dielectric filter of claim 1, wherein the plurality of resonators comprises a first resonator, a tail resonator, and at least one series resonator connected in series between the first resonator and the tail resonator, wherein a first stepped hole of the at least one stepped hole is provided between the first resonator and the adjacent resonator, and wherein a second stepped hole of the at least one stepped hole is provided between the tail resonator and the adjacent resonator.

11. The dielectric filter of claim 10, wherein six resonators included in the plurality of resonators are connected in series between the first resonator and the tail resonator.

12. The dielectric filter of claim 11, wherein the first resonator and the at least one series resonator are negatively coupled.

13. The dielectric filter of claim 11, wherein the tail resonator and the at least one series resonator are positively coupled.

* * * * *